United States Patent [19]

Arrowood

[11] 4,073,018

[45] Feb. 14, 1978

[54] INTERNAL BACK VENT SYSTEM

[75] Inventor: Gordon W. Arrowood, Palmetto, Ga.

[73] Assignee: McKenney's, Inc., Atlanta, Ga.

[21] Appl. No.: 563,482

[22] Filed: Mar. 31, 1975

[51] Int. Cl.[2] ..... E03D 9/04; F16L 41/00

[52] U.S. Cl. ..... 4/191; 4/211; 137/357; 137/588; 285/153

[58] Field of Search ..... 4/191, 192, 209, 211, 4/219, 252 R; 138/115; 137/587, 588, 561 A, 357; 285/153, 154

[56] References Cited

U.S. PATENT DOCUMENTS

| | | | |
|---|---|---|---|
| 922,311 | 5/1909 | Morton | 4/211 |
| 1,700,230 | 1/1929 | Luff | 4/211 |
| 2,067,078 | 1/1937 | Faber | 4/211 |
| 2,719,308 | 10/1955 | Choate | 4/211 |
| 2,795,798 | 6/1957 | Boggess et al. | 4/211 |
| 3,750,697 | 8/1973 | Kump | 4/211 |

*Primary Examiner*—Richard E. Aegerter
*Assistant Examiner*—Stuart S. Levy
*Attorney, Agent, or Firm*—Newton, Hopkins & Ormsby

[57] ABSTRACT

An internal back vent system which includes a single vertical stack divided by concentric vertically disposed vent and drain pipes into a main central drain or waste passageway surrounded by an annular vent passageway. Adjacent the floors to be serviced, the vertical stack is provided with manifold assemblies which interconnect the ends of branch waste pipes to the main drain passageway while venting each branch pipe to the vent passageway. The manifold includes a plurality of radially extending connector pipes all communicating with the main drain passageway. These outwardly extending connector pipes are respectively connected to the branch waste pipes which form the drains of the various fixtures within the building. At each level, a corresponding number of upstanding, relatively short, vent pipes are disposed, circumferentially spaced, in the annular vent passageway and are respectively connected by their lower ends to the connector pipes. Couplings having flexible gaskets surrounded by shields join the various butt connected pipes. A funnel shaped discharge member connects both the vent passageway and the drain passageway to the main drain.

11 Claims, 5 Drawing Figures

INTERNAL BACK VENT SYSTEM

BACKGROUND OF THE INVENTION

1. Field of the Invention:

This invention relates to an internal back vent system and is more particularly concerned with an apparatus by which a plurality of plumbing fixtures may be interconnected so as to be drained and vented through a single vertical stack, while, at the same time, complying with the applicable plumbing codes.

2. Background of the Invention:

Plumbing codes have, for some time, required that the branch waste drain pipe of each fixture in a building be provided with an individual vent pipe and that, in addition, the main drain also be provided with a vent pipe. Thus, each bathroom has been required, in the past, to have a plurality of vertically disposed pipes which must pass through the flooring and project outwardly of the roof. Hence in a conventional installation, there must be numerous openings in the flooring which will reduce the insulation efficiency of a building and numerous openings through the roof which might leak. Furthermore, and of primary importance is the fact that, such installations are time consuming to install and are expensive.

The present invention obviates the disadvantages described above by reducing the amount of vent piping required for each installation and by also reducing to a minimum the number of penetrations of the roof and slab or flooring.

The arrangement of the present invention also reduces the fire hazard by reducing the chimney effect which otherwise would be created when a plurality of penetrations of the slabs are provided.

The structure of the present invention also relieved the wall cavity clearance by providing only one vertical plumbing stack. In some instances, this facilitates the location of the plumbing by providing additional space in which the plumbing may be installed and by permitting the plumbing to be mounted close to an outer wall. The structure of the present invention also enables the drain liquids to be heated by the ground heat.

SUMMARY OF THE INVENTION

Briefly described, the present invention includes a manifold assembly or a plurality of manifold assemblies which are connected vertically together in tandem by central drain pipes, surrounded by main vent pipes. To each of these manifolds is connected the branch waste or drain pipes leading from several fixtures. The manifold assembly itself, includes a central hub and a plurality of connector pipes which radiate from the hub through a vent sleeve for communicating with the branch waste or drain pipes and the upstanding back vent pipes, the arrangement being such that the back vent pipes are in the annular space or vent passageway between the main vent pipes and the main drain pipe and communicate respectively with the fixture branch waste or drain pipes.

The lowermost main vent pipe includes a funnel shaped or tapered discharge member which leads to the main drain. A similar member (not shown) is provided at the upper end of the uppermost main vent pipe, leading to a roof stack pipe.

The back vent pipes are each short, upstanding tubular members whose height is dictated by the level of the liquid of the fixture which it serves, the code usually dictating that the vent pipe of each fixture be, as a rule, at least six inches above the normal overflow level of such fixture. Thus, the upper ends of the vent pipes each open to the main vent passageway.

The present invention also includes a couplings which is adapted to connect the branch waste pipes to the connector pipes of the manifolds. Furthermore, other couplings connect the joined waste pipes and the manifolds.

DETAILED DESCRIPTION

Figure 1:
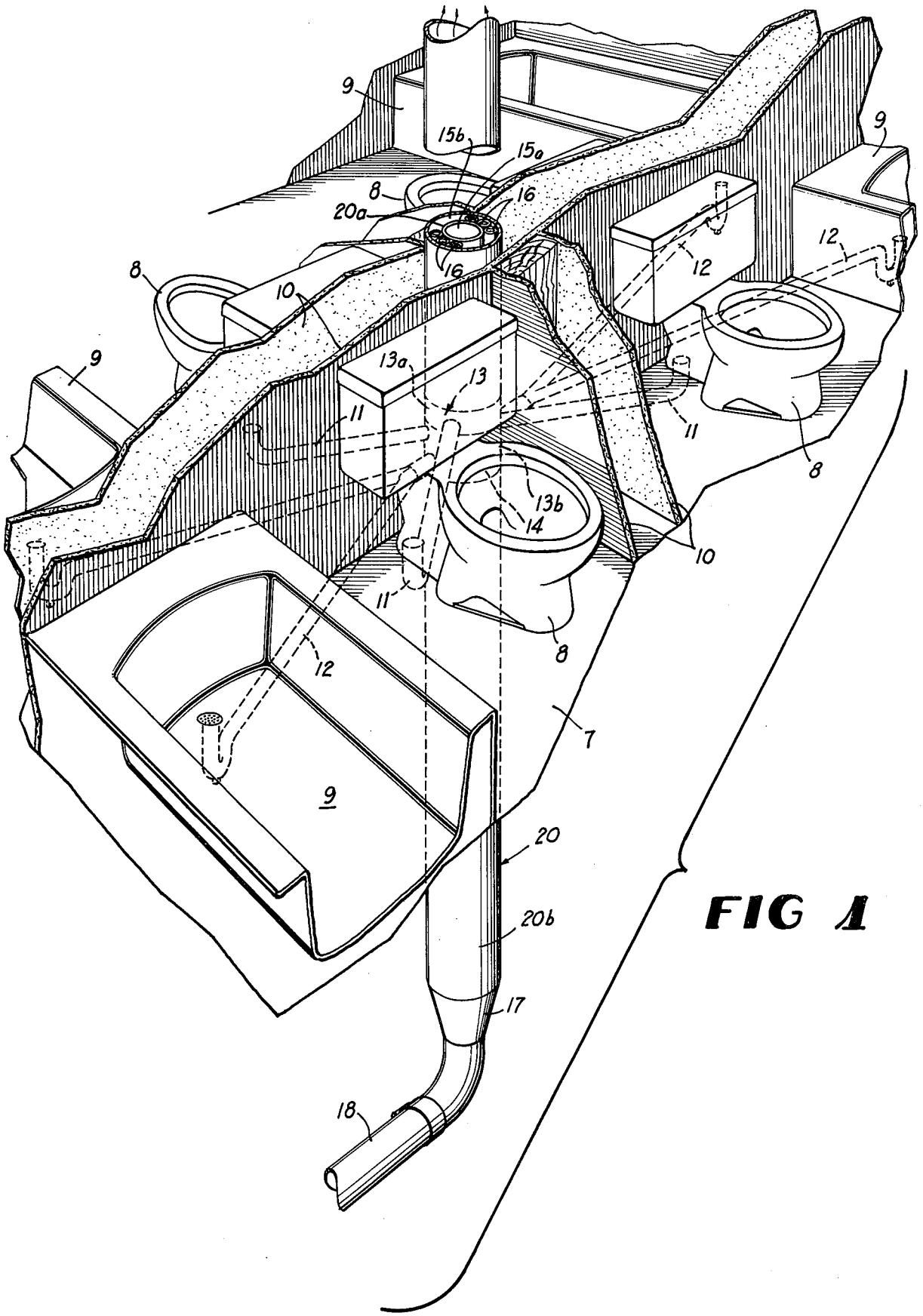
FIG. 1 is a perspective view, partially broken away, of one floor of a building containing plumbing fixtures and a drainage system which embodies the internal back vent system of the present invention.

Referring now in detail to the embodiments chosen for the purpose of illustrating the present invention, numeral 7, in FIG. 1 denotes a floor or slab, supporting a plurality of toilets or commodes 8 and a plurality of bathtubs 9.

For reducing the cost of installation, the commodes 8 are installed in the adjacent corners of the individual back-to-back and side-to-side bathrooms, the vertical walls 10 separating these commodes 8 so as to provide the individual bathrooms. Thus, the vertical walls 10 radiate from a common hub and enclose the vertical stack 20 of my internal back vent system.

As seen in FIG. 1, each commode 8 is provided with a conventional branch drain or waste pipe, denoted by numeral 11. In like fashion, each tub 9 is provided with a branch drain or waste pipe 12. These waste pipes 11 and 12 pass in the usual way beneath the floor 7, however, according to the present invention, they all converge on a manifold 13 consisting of an upper manifold **13*a* stacked on a lower manifold 13*b* of stack 20 having a main drain 20*a* and a main vent 20*b*, in vertical concentric relationship. Pipes 11 and 12 all lead through the outer sleeve 14 of manifold 13 to communicate with the main drain passageway 15*a* of drain 20*a*. Upstanding back vent pipes 16 in vent passageway 15*b* also communicate by their lower ends with the pipes 11 and 12**.

Both passageways **15*a* and 15*b* of the main drain 20*a* and the main vent 20*b* which surrounds the drain 20*a* communicate at their lower ends with a funnel shaped reducing coupling or discharge member 17 leading from vent 20*b* to a house main drain pipe 18. The upper end of the stack 20** is provided with a similar reducing coupling or discharge (not shown) leading to a single pipe (not shown) passing through the roof (not shown).

Figure 2:
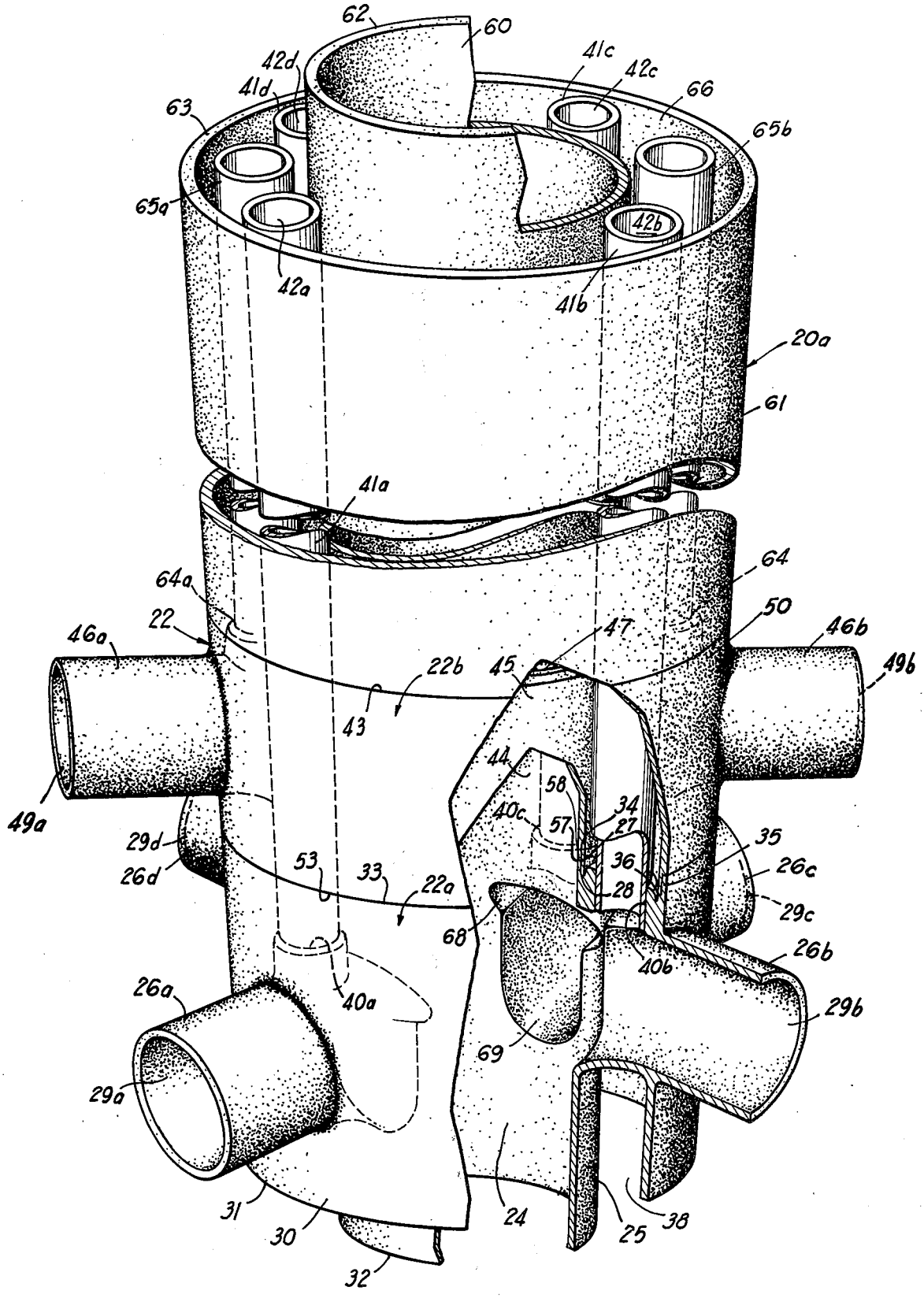
FIG. 2 is an enlarged perspective, partially broken away view of a second embodiment showing a typical manifold assembly for the internal back vent system of the present invention.

While numerous methods of fabricating a suitable vertical stack, such as stack 20 can be used, one of the preferred embodiments seen in FIG. 2 includes a partially prefabricated stack 20*a* in which a manifold 22 is produced at a plant or factory, for each floor so that they may be connected on the site by concentric pipes. In FIG. 2, the assembly 22 includes a plurality of stack manifolds, namely, lower manifold 22*a* and upper manifold 22*b* coaxially stacked and secured together in vertical alignment. Each manifold 22*a*, 22*b* includes a central hub and a plurality of circumferentially spaced, branch waste pipe connector pipes, radiating laterally from the hub through a sleeve.

In FIG. 2, the central hub 25 of lower manifold 22*a* is a right cylindrical member provided with four radially extending, circumferentially spaced, branch connector pipes 26*a*, 26*b*, 26*c* and 26*d*. The inner end of each pipe 26*a*, 26*b*, 26*c* and 26*d* connects with the central or inner, vertically disposed drain passageway 24 of hub 25. Thus, the passageways 29*a*, 29*b*, 29*c* and 29*d* communicate with drain passageway 24. The common transverse axis of the diametrically opposed pairs of the radially extending pipes 26*a*, 26*c* are perpendicular to and have their axes in common radial axis below the common radial axis of pipes 26*b*, 26*d*.

The central hub 25 is generally a right cylindrical member open at both ends and is of reduced internal diameter at its upper end portion to provide a lip or solder joint having an upstanding peripheral flange 27 and a radially disposed inwardly protruding, shoulder 28.

Surrounding the hub 25 is a right cylindrical sleeve 30 which forms the outer wall of the lower manifold 22*a*. The lower or bottom edge or end 31 of sleeve 30 terminates inwardly, ie., above, the lower end or edge 32 of hub 25. The upper or top edges 33 and 34 of sleeve 30 and hub 25 terminate in a common radial plane.

The upper edge portion of sleeve 30 is of enlarged internal diameter to provide a lip having an upstanding flange 35 and an inwardly protruding, radially disposed shoulder 36.

Between the hub 25 and sleeve 30 is the annular, vertically disposed outer vent passageway 38. Within the passageway 38, pipes 26*a*, 26*b*, 26*c* and 26*d* are, respectively, provided with upstanding sockets, such as sockets 40*a*, 40*b* and 40*c*, each of which is provided with an upwardly opening port, having a vertical axis. These ports respectively, receive the lower ends of and provide the sole support for a plurality of individual, parallel, upstanding, vertically disposed, circumferentially spaced, back vent pipes 41*a*, 41*b*, 41*c* and 41*d*. The lower ends of the individual vent passageways 42*a*, 42*b*, 42*c* and 42*d* of vent pipes 41*a*, 41*b*, 41*c* and 41*d*, communicate, as illustrated for passageway 42*b*, with the passageways 29*a*, 29*b*, 29*c* and 29*d*, respectively while the upper ends of passageways 42*a*, 42*b*, 42*c* and 42*d* terminate totally within and communicate with the vent passageway of the stack a short distance above the connector pipes 26*a*, 26*b*, 26*c* and 26*d*.

The upper manifold 22*b* includes an upper central hub 45 and an outer sleeve 50 in coaxially vertical alignment with and received respectively by the lower hub 25 and its sleeve 30. The hub 45 has a central vertical drain 44 communicating with drain passageway 24. The sleeve 50 and the hub 45 defined an annular vent passageway 58 vertically aligned and communicating with the annular vent passageway 38.

By way of illustration, the upper manifold 22*b* has two, diametrically opposed, branch waste pipe, connector pipes 46*a* and 46*b* having passageways 49*a* and 49*b* respectively. Pipes 46*a* and 46*b* project laterally or radially through their sleeve 50 and are respectively joined at their inner ends to the opposed sides of hub 45 so as to communicate with the drain passageway 44. Pipes 46*a* and 46*b* are about midway between the upper edge 43 and lower edge 53 of sleeve 50.

The hub 45 has, at its upper end, a peripheral flange 47 which forms an upwardly open soldering cup or bell for receiving the lower end of an upstanding or vertically disposed, right cylindrical waste or drain pipe 60. The lower edge of the hub 45 is provided with a downwardly protruding flange 57 which is received within the flange 27 with its lower end abutting shoulder 28. The hub 45 also has a radially disposed shoulder 58 which abuts edge 34. By reaching inside the hub 45, ie. in passageway 44, the joint, between hubs 25 and 45 can be readily soldered or brazed. The abutting flanged edges of sleeves 30 and 50, namely edges 33 and 53 are also soldered or brazed together. The brazing or soldering is normally accomplished at the factory. The upper edge 43 of sleeve 50 is provided with a flange and shoulder which receives a flange and shoulder of an upstanding right cylindrical main vent pipe 61 surrounding pipe 60. The upper end 62 of the drain pipe 60 terminates outwardly, in an axial direction, of the upper end 63 of pipe 61.

In the same manner as connector pipes 26*a*, 26*b*, 26*c* and 26*d*, the connector pipes 46*a* and 46*b* are provided with sockets 64*a* and 64*b* which receive the upstanding back vent pipes 65*a* and 65*b*, respectively. The back vent pipes 42*a*, 42*b*, 42*c*, 42*d*, 65*a*, 65*b* are arranged parallel to each other and are circumferentially spaced in satellite fashion around the main waste pipe 60. They, in turn, are surrounded by the main vent pipe 61, so as to be confined wholly with the annular vent passageway 66 defined by the concentric pipes 60 and 61.

In the present embodiment, the upper ends of all back vent pipes 42*a*, 42*b*, 42*c*, 42*d*, 65*a* and 65*b* terminate in a common radial plane, the requirement being that each back vent pipe should stand about six inches above the overflow line of its individual or related fixture. Hence, the height of an individual back vent pipe can vary according to the installation to be served.

Hubs 25 and 45 are shaped so that, inwardly of each socket 40*a*, 40*b*, 40*c*, 64*a*, 64*b*, each passageway 29*a*, 29*b*, 29*c*, 29*d*, 49*a*, 49*b* is widened at its top portion, as at numerals 68, and curved downwardly at its bottom portion, as at numeral 69. This is to facilitate drainage into the drain passageway 24.

The manifold assembly 22 and its pipes 60, 61, 42*a*, 42*b*, 42*c*, 42*d*, 65*a* and 65*b* depicted in FIG. 2, is to be prefabricated at a plant to accomodate the number of branch drain pipes to be connected thereto. Preferably, the manifolds 22*a* and 22*b* are unitary or integral brass castings while the pipes 42*a*, 42*b*, 42*c*, 42*d*, 65*a*, 65*b*, 60 and 61 are copper pipes. It will be understood by those skilled in the art that any one or more of the connector pipes 26*a*, 26*b*, 26*c*, 26*d*, 46*a* and 46*b* can be capped if it is not to be used.

Both the vertical spacing and the circumferential spacing of the connector pipes, such as pipes 26*a*, 26*b*, 26*c* and 26*d*, of each manifold assembly can be varied, as desired. Thus, in FIG. 1, the manifold assembly 13 should have six such connector pipes (not shown) for connection to branch waste pipes 11 and 12. In like fashion, connector pipes 29*a*, 29*b*, 29*c*, 29*d*, 46*a* and 46*b* are for being respectively connected to similar branch waste pipes (not shown).

Figures 3, 4:
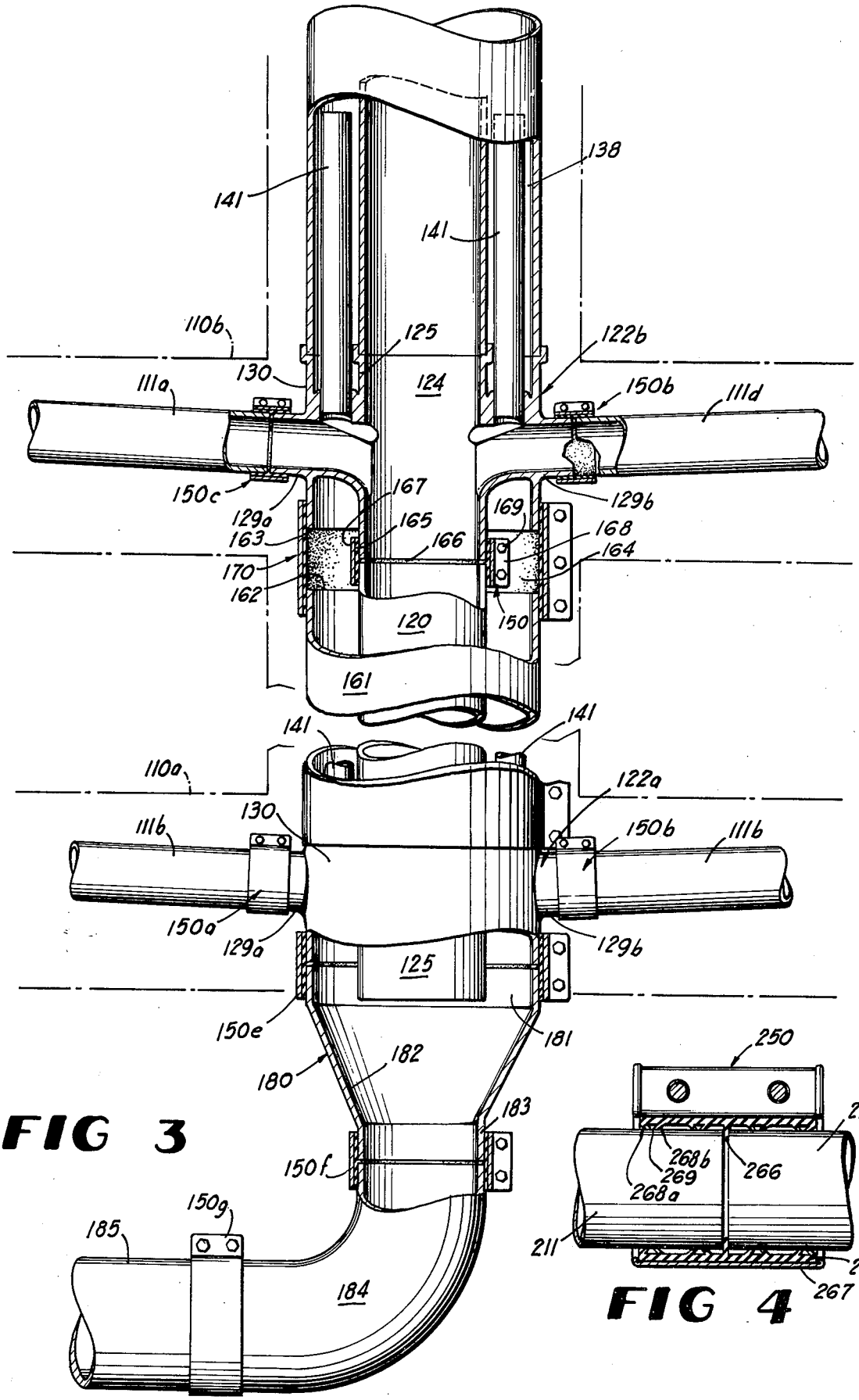
FIG. 3 is an enlarged side elevational view, partially broken away and illustrating still another internal back vent system of the present invention, being employed for servicing a plurality of floors of a building.
FIG. 4 is a vertical sectional view of a modified form of low pressure coupling in the present invention.

FIG. 3 depicts a third embodiment in which two identical manifolds 122*a* and 122*b* are provided immediately below floors 110*a* and 110*b*, respectively. Without going into great detail, each manifold 122*a* or 122*b* includes a central hub 125 having diametrically opposed, connector pipes 129*a* and 129*b* radiating therefrom. The connector pipes 129*a* and 129*b* communicate with the drain passageway 124 of hub 125 and pass outwardly through an outer sleeve 130 which is concentric with hub 125. Upstanding hollow, cylindrical, back vent pipes 141, disposed within the annular main vent passageway 138 respectively communicate with and respectively vent each pipe 129*a* and 129*b*, functioning in the same way as the hollow, cylindrical, back vent pipes 41*a*, 41*b*, 41*c*, 41*d*, 65*a* and 65*b*.

Joining the two vertically spaced and aligned hubs 125 is a right cylindrical main drain pipe 120, butt joined to the upper end of the hub 125 of lower manifold 122*a* and butt joined to the lower end of hub 125 of upper manifold 122*b*. A main vent pipe 161, which is shorter than the main drain pipe 120, surrounds pipe 120 and is mounted on or butt joined to the upper edge of the sleeve 130 of lower manifold 120*a* so as to terminate with its upper edge 162 spaced from the lower edge 163 of the sleeve 130 of upper manifold 122*b*. Thus, by lifting vent pipe 161, access may be had to the junction of pipe 120 and hub 125 of manifold 122*a*. Thereafter, the pipe 161 can be lowered to its original position and secured in place, to provide an access opening 164 for access to the junction of pipe 120 and hub 125 of manifold 122*b*. Of course, if desired, the lower manifold 122*a* and pipes 141 thereof, as well as pipes 120 and 161 can be prefabricated at the factory.

While many types of couplings or solder or welding can be used for joining the hubs 125 and pipes, such as pipe 120, in FIG. 3, I have depicted a low pressure coupling 150 having a cylindrical flexible elastomeric gasket 165 which surrounds the adjacent lower end portion of hub 125 of manifold 122*a* and the upper end and pipe 120. The central inner portion of gasket 165 is provided with a spacer ring or annulus 166 which is integrally connected to and protrudes inwardly in a radial plane from the central, radial portion of the gasket 165 so as to be disposed between the ends of hub 125 and pipe 120.

An interrupted, cylindrical compression band 167 surrounds the gasket 165, the ends of band 167 having circumferentially spaced, opposed, radially outwardly extending, flanges 168 which are normally spaced from each other and are drawn together by bolts 169, extending therebetween, to reduce the effective diameter of the band 167, when the bolts 169 are tightened.

The coupling 150 is also useful in joining the branch waste pipes such as waste pipes 11 and 12 to the connector pipes, such as connector pipes 25*a*, 25*b*, 25*c*, 25*d*, 46*a* and 46*b*. For example, in FIG. 3 we have illustrated the branch waste pipes 11*a*, 111*b*, 111*c* and 111*d* joined to their respective connector pipes 129 by couplings 150*a*, 150*b*, 150*c*, and 150*d*, respectively. Each of the couplings on 150*a*, 150*b*, 150*c* and 150*d* is identical to the coupling 150.

In FIG. 3, a coupling 150*e* which is of larger diameter than the couplings 150*a*, 150*b*, 150*c* and 150*d* joins the bottom portion of sleeve 130 to the upper portion of a hollow funnel shaped reducer element or discharge member 180. The elememt or member 180 includes a hollow tubular cylindrical entrance or throat member 181 which is of the same diameter as the diameter of the sleeve 130. The lower portion of the member 181 is joined to the upper edge portion of the periphery of the frusto-conical body 182 of element 180. The lower portion of the body 182 merges with a discharge member 183. This discharge member 183 is a hollow cylindrical and is butt joined to one end of an elbow 184 which joins to the main drain pipe 185. Coupling 150*f*, similar to coupling 150 joins the upper end of the elbow 184 to the lower end of the discharge member 183. In like fashion a similar coupling 150*g* joins the other end portion of elbow 184 to the main drain pipe 185. The main drain pipe leads to an appropriate sewerage connection.

In FIG. 4 is a modified form of the coupling similar to coupling 150 hereinabove described. This coupling, denoted generally by numeral 250, includes a cylindrical, flexible, elastomeric gasket 265 which surrounds the adjacent end portions of pipes such as pipes 211 and 229. The central portion of the gasket 265 is provided with a spacer ring or central annulus 266. The gasket 265 is surrounded by a compression band 267 which functions in the identical way that the compression band 167 functions.

In this modified form depicted in FIG. 4, there are provided opposed pairs of circumferentially disposed lips 268*a* and 268*b* protruding in converging fashion from the inner surface of gasket 265. These lips 268*a* and 268*b* are continuous radially disposed inwardly extending members which are spaced from each other to provide a central gap 269 therebetween. The lips, as they protrude inwardly toward the axis, also taper toward each other so that as the pipe 211 or 229 is received so as to abutt the flange 266, the lips 268*a* and 268*b* are deflected in radial directions so as to form ceiling labyrinths to preclude the flow of fluid past the gasket. The opposed pairs of lips 268*a* and 268*b* are spaced radially from each other and also from the central annular spacer ring 266.

While in the preferred embodiment depicted in FIG. 4, there are two groups of the opposed lips 268*a* and 268*b* on each side of ring 266, as many opposed pairs of circumferential lips 268*a* and 268*b* can be provided, as desired.

Figure 5:
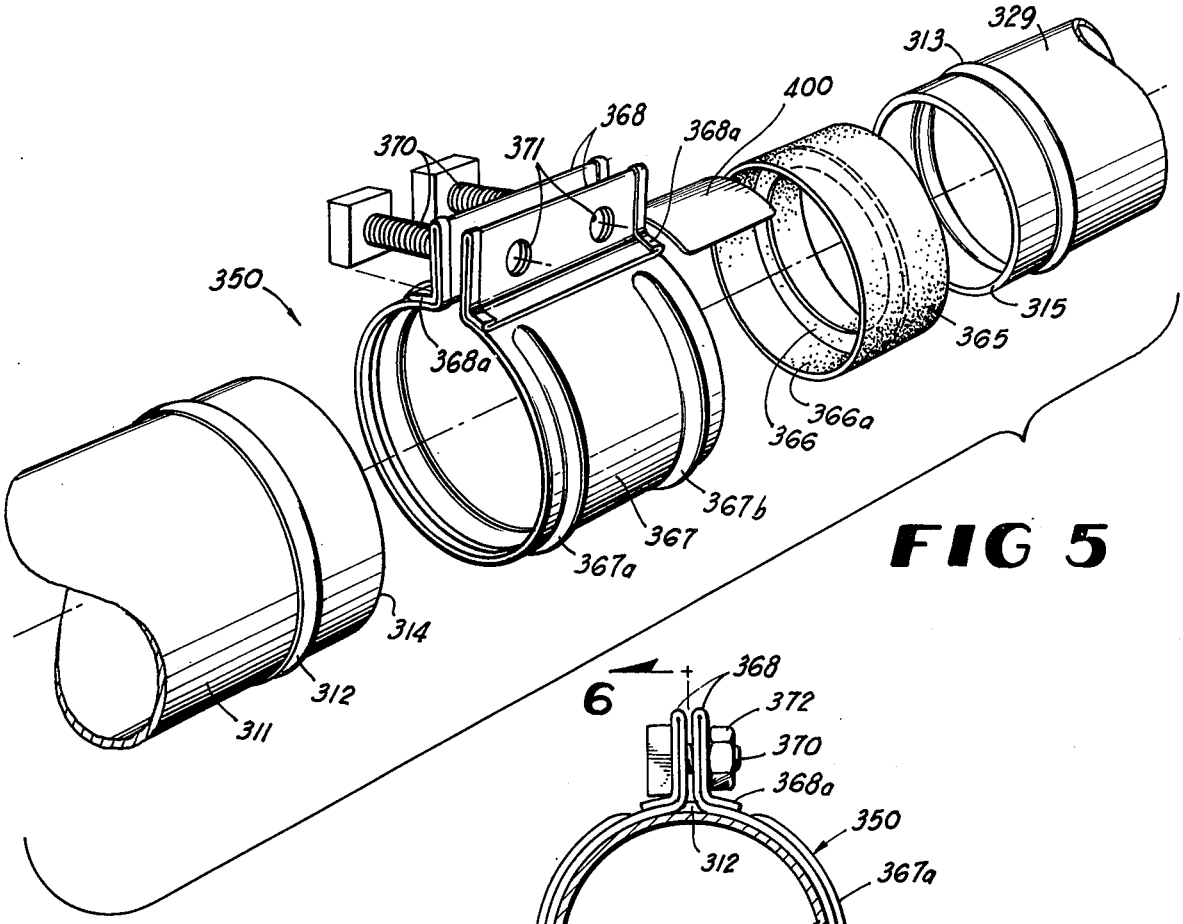
FIG. 5 is an exploded perspective view of the high pressure coupling utilized in the internal back vent system of the present invention.
Figure 6:
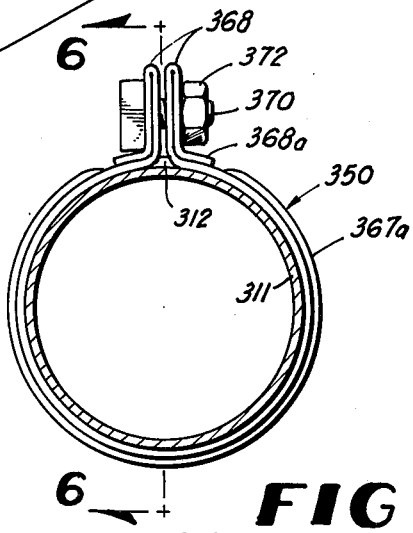
FIG. 6 is a vertical sectional view of the assembled high pressure coupling depicted in FIG. 4.
Figure 7:
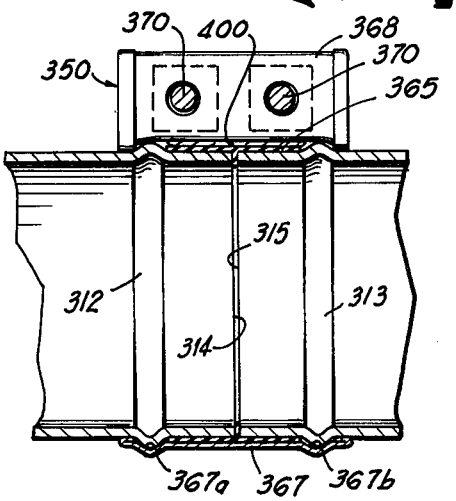
FIG. 7 is a vertical sectional view taken substantially along line 6—6 in FIG. 5.

If a high pressure coupling is desired for joining the branch waste pipes to the connector pipes, such as branch waste pipe 311 to the connector pipe 329, a coupling 350 depicted in FIGS. 5, 6 and 7 should be used. In such case, connector pipes 311 and 329 are respectively provided with a circumferentially outwardly deformed flange such as flanges 312 and 313. The flanges 312 and 313 are adjacent to but spaced from the ends 314 and 315 of the pipes 311 and 329.

A cylindrical flexible elastomeric gasket 365 which is similar to gasket 165 is provided for this coupling 350. The gasket 365 includes a spacer ring 366 which is identical to the spacer ring 166. In the present embodiment however, the inner periphery of the gasket 365 may, if desired, be embedded with Carborundum, or aluminum oxide or some other granular abrasive material so as to resist sliding, once the gasket has been installed. The Carborundum is denoted generally by numeral 366*a*. The length of gasket 365 corresponds to the space between the flanges 312 and 313 when the ends 314 and 315 sandwich the spacer ring 366, therebetween as seen best in FIG. 7.

In FIG. 5, an arcuate rectangular shield or compression plate 400 is shown. The function of the plate 400 is to fit between the band 367 and the gasket 365 at the gap in the gasket and prevent the ends of the band from pinching the gasket as the band is tightened.

A compression band 367 surrounds the outer surface of the gasket 365 and extends over and outwardly of the circumferential flanges 312 and 313. The compression band 367 is deformed outwardly to provide circumferential grooves 367*a* and 367*b* for receiving, respectively, and conforming to the contour of the flanges 312 and 313 when the compression band 367 is installed over the ends of the pipes 311 and 329. The compression band extends circumferentially around substantially the entire periphery of the gasket 365; however, the adjacent ends of the band 367 are bent outwardly to provide a pair of spaced, opposed, radially, outwardly extending flanges 368 which are reinforced by being reversely bent as depicted in FIG. 5, the flanges terminating in stub flanges 368*a*. The flanges 368 are provided with spaced holes 371, through which project the bolts 370 for urging the flanges together, when the nuts such as nut 372 are received thereon. Upon tightening of the bolts of the nuts 372 on bolts 370, the compression ring is urged tightly around the gasket 365 and urges the pipes 311 and 329 together, due to the camming action of the grooves 367*a* and 367*b* against the flanges 312 and 313.

While I have not illustrated the arrangement of the vent pipe which protrudes outwardly through the roof, it will be understood by those skilled in the art that a funnel shaped or frusto-conical discharge element or member such as element 180 is provided at the upper end of the stack. This, in turn, is connected to a simple cylindrical vent pipe protruding outwardly through the roof. Thus, both at the top and at the bottom, the main drain passageway 124 terminates within the element 180 or its corresponding element, so that the vent passageway 138 as well as the drain passageway 124 are in communication with each other and also in communication with the element such as element 180.

In operation, the waste materials from fixtures, such as commodes 8 and tubs 9 drain via pipes 11 and 12 or via 111*a*, 111*b*, 111*c*, 111*d* or via pipes 29*a*, 29*b*, 29*c*, 29*d*, 46*a*, 46*b* into the central drain passageway 15*a*, 124 or 24, as the case may be, and thence into the main drain such as drain 18 or 185.

Any fumes, vapors or gases in pipes 11, 12, 111*a*, 111*b*, 111*c*, 111*d*, 29*a*, 29*b*, 29*c*, 29*d*, 46*a* and 46*b* are vented, via the vent pipes 16, 41*a*, 41*b*, 41*c*, 41*d*, 141 and vent passageway 15*b*, 38 and 138 and pass, as the arrows in FIG. 1 indicate, upwardly and out through the discharge arrangement in the roof. Fumes, vapors and gases from drain passageay 15*a*, 24, 124 also pass upwardly through both the vent passageway 15*b* 38 or 138 and the drain passageway 15*a*, 24 or 124 and are discharged with the other fumes. Thus, the ground heat supplied by these fumes, vapor and gases retard the likelihood that freezing of the waste liquid will occur in the system.

In the event of blockage in the drain passageway 15*a*, 24 or 124 the various vent pipes 16, 41*a*, 41*b*, 41*c*, 41*d*, 65*a*, and 65*b* and 124 can function to permit an overflow to the drain, such as drains 18 and 185, via the vent passageways 156, 38 and 138. This, however, will not normally occur.

I claim:

1. A back vent drain system comprising:

a. a main upright drain for defining a drain passageway, therethrough;

(b) a main upright vent disposed adjacent to and surrounding said drain, said main vent and said main upright drain defining therebetween a vent passageway;

(c) a plurality of branch waste pipes extending through said main upright drain and communicating with said drain passageway of said drain; and (d) a plurality of upstanding tubular back vent pipes wholly within said vent passageway and between said main upright drain and said main upright vent, the lower ends of said back vent pipes respectively being received within said vent passageway by and communicating with said branch waste between said main upright drain and said upright vent pipe, the upper ends of said back vent pipes terminating within said vent passageway.

2. The back vent drain system defined in claim 1 wherien said main upright drain and said vent are concentric and wherein said vent passageway between said main upright drain and said main upright vent pipe is annular, said back vent pipes being disposed circumferentially around said main upright drain.

3. The back vent drain system defined in claim 1 including a funnel shaped discharge member connected to the lower end of said main upright vent, the lower end of said main upright drain passageway and the lower end of said main upright vent passageway communicating with said discharge member.

4. The back vent drain system defined in claim 1 wherein said main upright drain includes a plurality of vertically aligned drain pipes, hubs between said drain pipes and wherein said main upright vent includes a plurality of vertically aligned vent pipes and a sleeve connecting said vertically aligned vent pipes, and wherein said branch waste pipes include connector pipes protruding from said hub outwardly through said sleeve.

5. The back vent drain system defined in claim 4 wherein said branch waste pipes include pipe members abutting said connector pipes, and a coupling surrounding the abutting ends thereof, said coupling including an elastomeric cylindrical gasket and a compression band around said gasket.

6. A manifold for use in a back vent drain system comprising:

(a) a hub for forming with main drain pipes a portion of a central drain passageway;

(b) a plurality of circumferentially spaced connector pipes extending outwardly from said hub;

(c) a sleeve surrounding said hub, said sleeve being spaced from said hub for forming with main drain pipes a vent passageway around said hub in the space between said hub and said sleeve, said connector pipes projecting through said sleeve; for connection with branch waste pipes; and (d) said connector pipes being respectively provided with upwardly opening vent ports wholly within said vent passageway between said sleeve and said hub for communicating with the lower ends of upstanding vent pipes which are to be carried within said vent passageway by said manifold for forming with said vent pipes individual vents for said branch waste pipes.

7. The manifold defined in claim 6 wherein all of said ports open in the same direction.

8. The manifold defined in claim 7 including a plurality of back vent pipes are disposed in said vent passageway, said pipes communicating respectively with said ports and also communicating with said vent passageway.

9. The manifold defined in claim 8 wherein said back vent pipes extend in an axial direction and are circumferentially disposed around said hub.

10. The manifold defined in claim 8 including a main central drain pipe protruding axially from said hub, a main vent pipe surrounding said central drain pipe protruding axially from said sleeve, said main central drain pipe having a drain passageway communicating with the drain passageway of said hub, said main vent pipe having a vent passageway communicating with said vent passageway of said sleeve, said main drain and said main vent pipe being concentrically disposed.

11. The manifold defined in claim 10 wherein said back vent pipes terminate within said vent passageway of said main vent pipe.

* * * * *